United States Patent [19]

Leiblich

[11] 4,073,112

[45] Feb. 14, 1978

[54] STRUCTURAL PANEL

[76] Inventor: Gordon Francis Leiblich, Box 157, Kimba, South Australia, Australia

[21] Appl. No.: 604,987

[22] Filed: Aug. 15, 1975

[30] Foreign Application Priority Data

Aug. 20, 1974 Australia ..... 8585/74

[51] Int. Cl.[2] ..... E04C 5/16

[52] U.S. Cl. ..... 52/677; 52/350; 256/32

[58] Field of Search ..... 256/47, 48, 34, 32; 52/677, 684, 685, 687, 688, 719, 670, 350, 356

[56] References Cited

U.S. PATENT DOCUMENTS

| | | | |
|---|---|---|---|
| 429,935 | 6/1890 | Miles | 52/648 |
| 657,827 | 9/1900 | McCall | 52/350 |
| 943,696 | 12/1909 | Mooney | 52/356 |
| 1,324,360 | 12/1919 | Schoenthaler | 52/684 |
| 1,588,661 | 6/1926 | Clark | 52/672 |
| 1,641,872 | 9/1927 | Southwell | 52/684 |
| 1,668,935 | 5/1928 | Bradbury | 52/684 |
| 1,882,499 | 10/1932 | Johns | 52/685 |
| 2,083,300 | 6/1937 | Harlbert | 52/672 |
| 3,412,512 | 11/1968 | Hollister | 52/350 |
| 3,865,349 | 2/1975 | Leiblich | 256/47 |

FOREIGN PATENT DOCUMENTS

| | | | |
|---|---|---|---|
| 2,142,088 | 3/1972 | Germany | 52/671 |
| 21,801 of | 1910 | United Kingdom | 52/670 |

*Primary Examiner*—Price C. Faw, Jr.
*Assistant Examiner*—Henry Raduazo
*Attorney, Agent, or Firm*—Michael P. Breston

[57] ABSTRACT

A structural panel having a mesh sheet which is stiffened by one or a series of stiffeners each of which has a plurality of hook-like tongues which engage and retain rod portions of the mesh sheet.

1 Claim, 8 Drawing Figures

STRUCTURAL PANEL

BACKGROUND OF THE INVENTION

This invention relates to a structural panel of the type incorporating a sheet comprising a plurality of interconnected rods. It may incorporate a "weld mesh" sheet having rods in two parallel rows, the rods of one row intersecting those of another row at right angles to one another, the intersecting points being welded together. Alternatively it can incorporate a sheet of metal which has been expanded, for example to a hexagonal pattern.

Sheets of the abovementioned type are frequently used for varying purposes, for example for reinforcing of concrete slabs or walls, the construction of grain silos, the construction of stockyards, and for very many other purposes. However the effectiveness of the panels is seriously limited by their flexibility, and in many instances the panels are not self-supporting. Thus for example when a weld mesh sheet is used for the reinforcing of a concrete floor slab, it is necessary to use a large number of support chairs to raise the panels from the ground. When used for grain silos or stockyards panels, the panels need to be used in association with posts to which they can be nailed or welded, in order to obtain a desirable degree of rigidity.

The main object of this invention is to provide improvements whereby the panels have substantial rigidity imparted thereto.

In the Complete Specification accompanying my Australian Patent Application No. 55,838/73 based on the Provisional Application No. PA 9049 dated May 23, 1972 and corresponding to U.S. Pat. No. 3,865,349, I described and claimed a fence dropper having a body portion arranged to extend rearwardly away from the plane of a fence when supported by the dropper and to have a higher moment of inertia at right angles to said plane than parallel with said plane, a plurality of tongues spaced from one another alfong one edge of the body portion, each tongue having as its root a bridge portion joining it but spacing it from said body portion edge and extending forwardly of said plane from said root, said tongue further having a return portion which terminates rearwardly of said plane to thereby define with said body portion a wire retaining aperture extending across the plane of the fence.

BRIEF SUMMARY OF THE INVENTION

Briefly, the invention may be summarised as comprising in combination, a mesh sheet and at least one stiffener which has similar characteristics to the fence dropper defined above. The stiffener tongues engage the mesh sheet to form an assembly which is much more rigid than the mesh sheet per se. The stiffener (or stiffeners) may be wired to the mesh sheet to prevent dislodgement.

More specifically in this invention a structural panel comprises a mesh sheet having a plurality of rod portions which are parallel with one another, and at least one stiffener, the or each said stiffener having a body portion which extends away from a plane in which the rod portions lie, and a plurality of tongues, each tongue having a bridge portion joining it to but spacing it from the body portion, and a forwardly projecting portion merging into a rearwardly extending return portion to form a hook-like configuration which co-operates with said body portion to form a retaining aperture in the end elevation of the stiffener, there being a plurality of said rod portions extending through respective said retaining apertures to thereby retain the mesh sheet and stiffener as an assembly.

BRIEF DESCRIPTION OF THE VIEWS OF THE DRAWINGS

Embodiments of the invention are described hereunder in some detail with reference to and are illustrated in the accompanying drawings, in which.

DETAILED DESCRIPTION OF THE DRAWINGS

Figure 1:
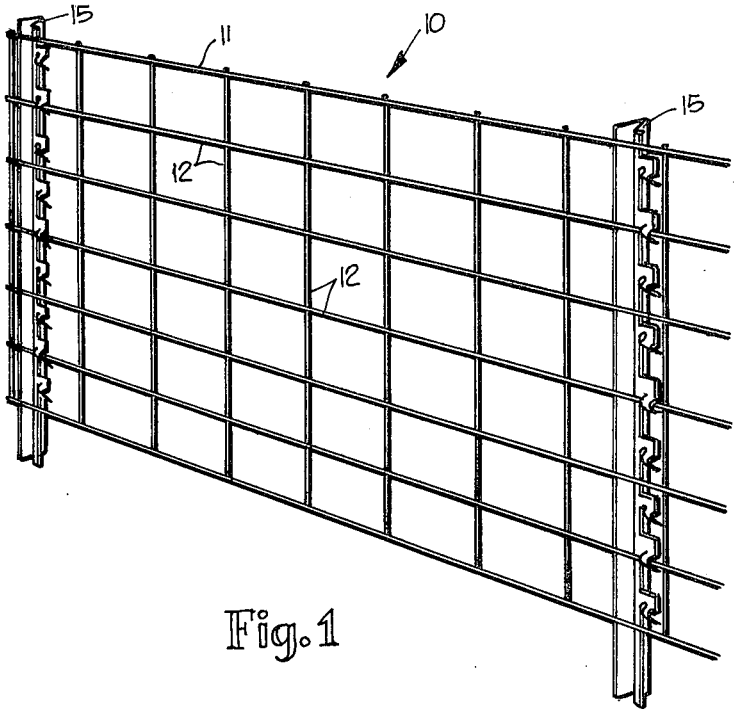
FIG. 1 is a perspective view of a structural panel according to a first embodiment.

In the embodiment of FIG. 1 a structural panel 10 is formed from a sheet 11 of material known as "weld mesh". This sheet comprises two rows of rods 12, the rods 12 in any one row being parallel to the other rods in that row but spaced therefrom, the rods of each row being welded to those of the other row at the intersecting points.

Figure 4:
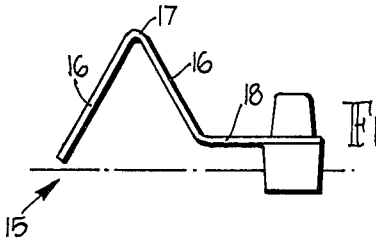
FIG. 4 is a top view of a stiffener which is used in the first embodiment of FIG. 1.
Figure 5:
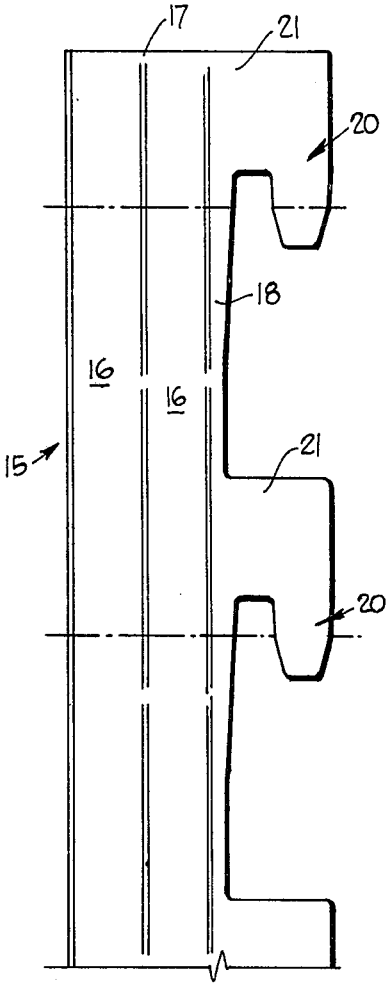
FIG. 5 is a side elevation of FIG. 4.
Figure 6:
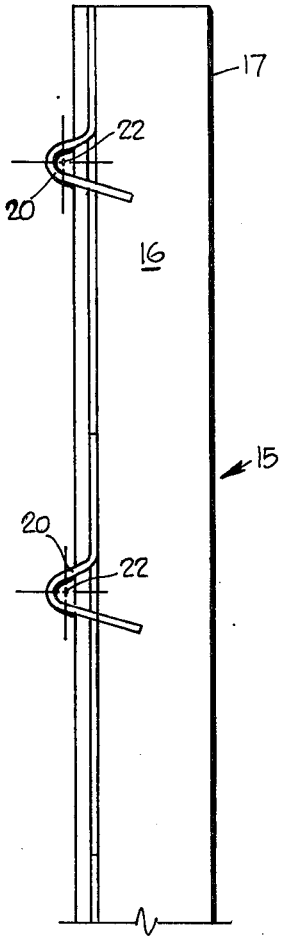
FIG. 6 is an end elevation of FIG. 5.

As shown in FIGS. 4, 5 and 6, a stiffener 15 is formed from sheet metal to have a channel section so that its moment of inertia between the mouth and root of the channel is higher than the moment of inertia at right angles thereto. The side walls 16 converge towards the root 17 of the channel, the root 17 of the channel being curved. One of the side walls 16 terminates in a flange 18.

The flange 18 is provided with a plurality of equally spaced tongues 20, each tongue 20 having a small bridge portion 21 which functions as the root of the tongue and joins the tongue to an edge of a side wall 16 of the stiffener 15, each tongue extending from the flange portion in a direction which is parallel to the longitudinal axis of the stiffener. However, when viewed in side elevation, each tongue is formed forwardly from the plane of the flanges of the stiffener, the tongue having a return portion so that is of hook-like configuration and defines with the flanges an aperture (designated 22) which exists when viewed in side elevation, and not when viewed in front elevation. Each tongue 20 is displaced from the edge of the body portion by a distance which is equal to its own width at any one point. The shape of the recess and the shape of the tongue is identical so that a single shearing operation between two stiffeners produced simultaneously results in the formation of the tongues and recesses of each.

Figure 7:
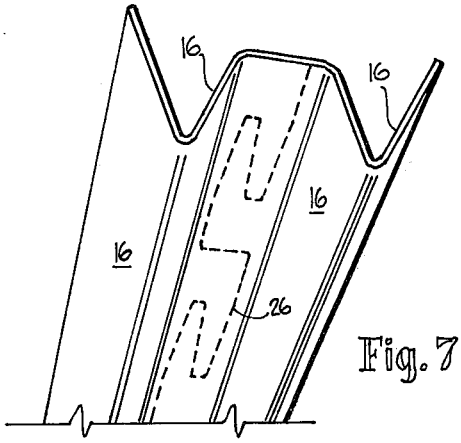
FIG. 7 illustrates a method of production of the stiffeners illustrated in FIGS. 4, 5 and 6.

In this embodiment the stiffener is produced as shown in FIG. 7, by a method of firstly forming a strip of sheet metal to have a pair of formed body portions 16 extending parallel to each other, and each comprising a longitudinal axis of a body portion of a stiffener, the two body portions being joined together by a bridging web 25 which is subsequently sheared along the dotted line 26 to form the tongues and recesses in both portions, each tongue of one stiffener being complementary in shape to the recess of the other.

The stiffeners are then located on the "weld mesh" sheet 11 by positioning the plane of the flange 18 at right angles thereto with the tongues adjacent corresponding rods, moving the stiffener in the direction of its own longitudinal axis, and rotating until the flange is contiguous with one face of the weld mesh sheet 11, whereupon the tongues 20 will engage some of the rods 12. In some instances it is possible to have each rod engaged by a respective tongue, although of course in other instances this is unnecessary, and (as shown in FIG. 1,) some of the rods of one row are engaged by respective tongues, while others are not.

Figure 2:
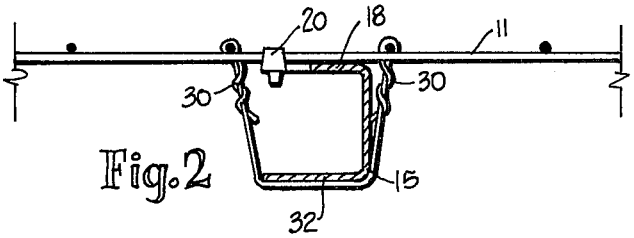
FIG. 2 is a section of a panel used as a reinforcement for a concrete floor, being a second embodiment.
Figure 8:
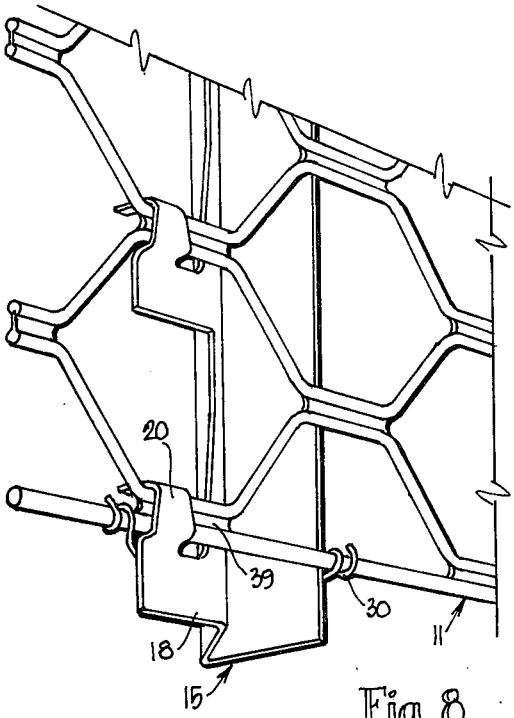
FIG. 8 is an enlarged fragmentary view showing a panel utilising a sheet of metal which has been expanded from extruded aluminium.

In some cases the panel is formed merely as described above, whereas in other cases the stiffener is secured to the weld mesh sheet, for example by tying with tie wire 30, as in the embodiments of FIGS. 2 and 8. Where the stiffener is not to be secured at its ends to any supporting structure, some tying or welding is deemed necessary whereas if the stiffener is itself to be rigidly supported at its ends or intermediate its ends to some supporting structure, this may be avoided.

Referring now to the embodiment of FIG. 2, a stiffener again designated 15 is formed to a channel shape section having a tongue flange again designated 18 from which a series of tongues 20 project, and a support base flange designated 22 suitable for supporting the stiffener 15 from the ground so that the mesh sheet 11 is retained adjacent to but spaced from the ground, thereby enabling concrete to be poured through the mesh sheet 11 and to embody the mesh sheet 11 after pouring. In this instance the tie wire 30 retains the stiffener 15 to the mesh sheet 11.

Figure 3:
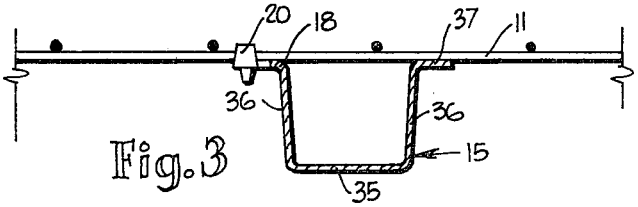
FIG. 3 is a section similar to FIG. 2 but according to a third embodiment.

In FIG. 3 the stiffener 15 is again used for supporting the mesh sheet 11 from the ground, but the panel shape insludes a flange 18 having the tongues 20 projecting upwardly therefrom and the stiffener 11 having a base 35 supporting it from the ground, having two upstanding webs 36 from one of which the flange 18 projects and from the other of which a further flange 37 projects.

In FIG. 8 the configuration of the stiffener 15 is similar to that of FIGS. 1, 4 5 and 6. The flange 18 carries on it outstanding tongues 20 but in this embodiment the mesh sheet 11 is not formed from welded rods, but is formed by a process of expanding aluminium which has been extruded and slotted. Such a product and the method of production is described fully in the U.S. Pat. No. 3,774,274 (Harold R. Jury). Aluminium is first extruded to have a series of rod-like members interconnected by webs, each web having formed therein a row of elongate slots which are staggered with respect to a similar adjacent row, and the product is subsequently expanded. The tongues 20 engage rod portions 39 of the product 11.

Although the invention is essentially simple it provides means whereby a mesh panel is quickly and easily made stiff and self-supporting, and it provides as a new product a stiffened mesh panel which has many structural and other uses.

What I claim is:

1. A structural panel comprising:

a. a mesh sheet having a plurality of rod portions having the same thickness and which are parallel with one another;

b. a plurality of stiffeners, each stiffener having:

1. a body portion which extends away from the plane in which the rod portions lie;
2. a plurality of tongues each joined to the body portion by a respective bridge portion which spaces the tongue from the body portion by a distance at least equal to said rod thickness, each bridge portion lying in a plane parallel to the plane in which the rod portions lie,
3. each tongue extending upwardly from the bridge portion to form therewith a slot which is open-ended in a first view of the stiffener, and each tongue having a forwardly projecting portion merging into a rearwardly extending return portion to form a hook-like configuration which co-operates with said body portion to form a retaining aperture in a second view of the stiffener at right angles to the first said view; and c. a plurality of said rod portions extending through respective ones of said retaining apertures to thereby retain the mesh sheet and stiffener as an assembly, the assembly of each stiffener to a mesh sheet being effected by positioning said slots of that stiffener over respective ones of said rod portions and rotating the stiffener through an angle of 90°.

* * * * *